US005528845A

United States Patent [19]

Grate

[11] Patent Number: 5,528,845

[45] Date of Patent: Jun. 25, 1996

[54] ATTRACTION BOARDS AND THE MOUNTING THEREFOR

[76] Inventor: Anton Grate, 405 Westridge, Joliet, Ill. 60435

[21] Appl. No.: 295,405

[22] Filed: Aug. 25, 1994

[51] Int. Cl.[6] ..... G09F 13/04

[52] U.S. Cl. ..... 40/576; 40/620

[58] Field of Search ..... 52/74; 40/576, 40/657, 620

[56] References Cited

U.S. PATENT DOCUMENTS

| | | | |
|---|---|---|---|
| 1,447,918 | 3/1923 | Zacher | 40/576 |
| 1,480,019 | 1/1924 | Siimpson | 40/576 |
| 2,313,723 | 3/1943 | Adler | 40/576 X |
| 2,501,084 | 3/1950 | Ownbey | 40/576 X |
| 3,084,464 | 4/1963 | Ladbury | 40/620 |
| 3,092,171 | 6/1963 | Deddo | 52/74 X |
| 3,492,747 | 2/1970 | May | 40/657 X |
| 4,461,107 | 7/1984 | Grate | 40/576 |
| 5,148,640 | 9/1992 | Reilly, Sr. | 52/74 |
| 5,357,701 | 10/1994 | Grate | 40/620 X |

*Primary Examiner*—Joanne Silbermann
*Attorney, Agent, or Firm*—Patnaude, Videbeck & Marsh

[57] ABSTRACT

A frame is attachable to a vertical wall of a building and includes a plurality of arms which extend outwardly from the wall. An attraction board is supported at the distal ends of the outwardly extending arms, and an awning is extended across the arms and attached thereto.

8 Claims, 11 Drawing Sheets

ATTRACTION BOARDS AND THE MOUNTING THEREFOR

The present application relates to attraction boards used by business establishments to draw attention to their products or services and in particular to attraction boards adapted to receive a panel of signage across the front thereof.

BACKGROUND OF THE INVENTION

Businesses have long used attraction boards to acquaint the public with their services or products. Such boards have a plurality of parallel horizontally oriented tracks adapted to receive replaceable figure panels. The replaceable figure panels have letters or numbers printed thereon, and are arranged in the tracks of the attraction board to spell out words and prices.

Typically, such attraction boards are supported by one or more vertical posts, or are affixed to the side of a building. Such mountings are satisfactory where there is sufficient open space for a free standing structure, or sufficient space on the wall of a building for supporting an attraction board. Many business establishments, however, cannot utilize either of the existing available mountings. For example, certain shopping centers have stores positioned in side-by-side relationship such that only the front of the store is visible to the public. Where the roof line or other features of the structure limit the available area which can be utilized for signage, the establishment may be required to place an attraction board within its front window. Such a location is unattractive and inhibits the full usage of the limited window space available to such establishments.

On many occasions, business establishments have exterior structures for supporting an awning, which adds to the attractiveness of the building. Such awnings can be printed with signage, but in the past, awnings have reduced the space available for an attraction board.

It would, therefore, be desirable to provide a mounting for an attraction board which would be attached to an outer wall of a building and usable for providing an awning.

Typical attraction boards provide for a plurality of tracks such that letters or numbers may be mechanically or electronically depicted on each of the tracks to form words and numbers. The alternative to an attraction board is a sign which may include both printed text and artistic material. Prior to the present invention, however, business establishments have had to elect between the use of an attraction board for which the text material may easily be changed, and an artistically appealing sign. The changing of the artistic material and text on a sign, however, is generally more extensive and time consuming than the changing of the text material on an attraction board.

It would also be desirable to provide an attraction board having a plurality of tracks for receiving print material thereon, and which is suitable for receiving a sign across the forward surface or face thereof. It would also be desirable to provide a method and apparatus for removably installing a display panel or sign across the forward surface of an attraction board such that signage may be easily positioned across the attraction board or removed therefrom.

SUMMARY OF THE INVENTION

The present invention is a frame attachable to a vertical wall of a building and includes a plurality of arms which extend outwardly from the wall. In accordance with the present invention, an attraction board is supported at the distal ends of the outwardly extending arms of the frame, and an awning is extended across the arms and attached thereto.

An attraction board in accordance with the present invention has a plurality of horizontally oriented parallel tracks positioned on a vertically oriented rear panel. Along an upper edge of one of the upper tracks is a forward downwardly extending upper lip which is positioned forward of the upper edge of the upper track. A forward upwardly extending lower lip is positioned along the lower edge of a lower track and extends forwardly of the lower track. A display panel or sign having a retaining frame and a replaceable webbing attached thereto can then be fitted between the forward downwardly extending forward upper lip and forward upwardly extending forward lower lip.

The retaining frame for the display panel has one or more loops positioned near the outer edge thereof, and each of the loops is adapted to receive a hook located at the end of an elongate installation stick. The hook on the stick may then be positioned through the loops of the retaining frame to lift the frame and position it between the upper and lower first lips of the attraction board.

GENERAL DESCRIPTION OF THE DRAWINGS

A better understanding of the present invention will be had by reference to the following detailed description taken in conjunction with the accompanying drawings wherein.

DETAILED DESCRIPTION OF A PREFERRED EMBODIMENT

Figure 1:
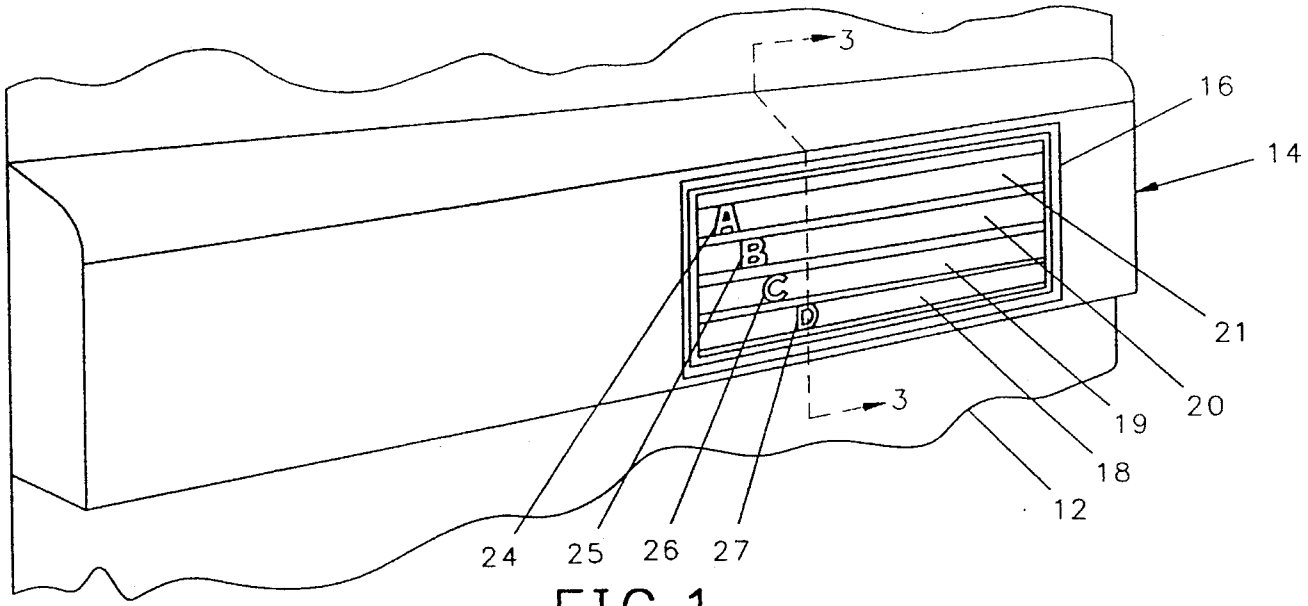
FIG. 1 is an isometric drawing of a wall upon which a an attraction board has been attached using a mounting structure in accordance with the present invention.
Figure 2:
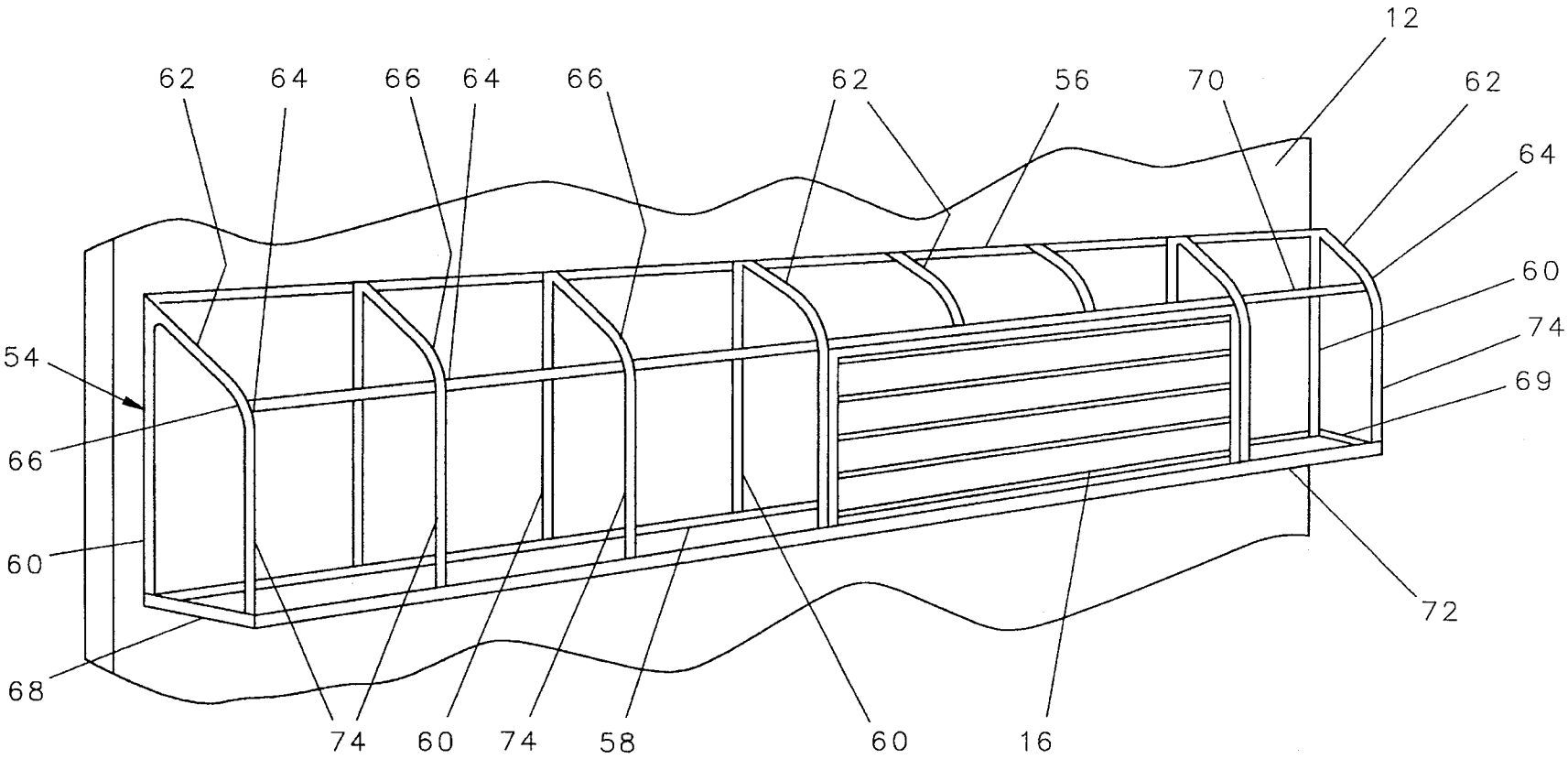
FIG. 2 is an isometric view of the mounting structure for the attraction board shown in FIG. 1.
Figure 3:
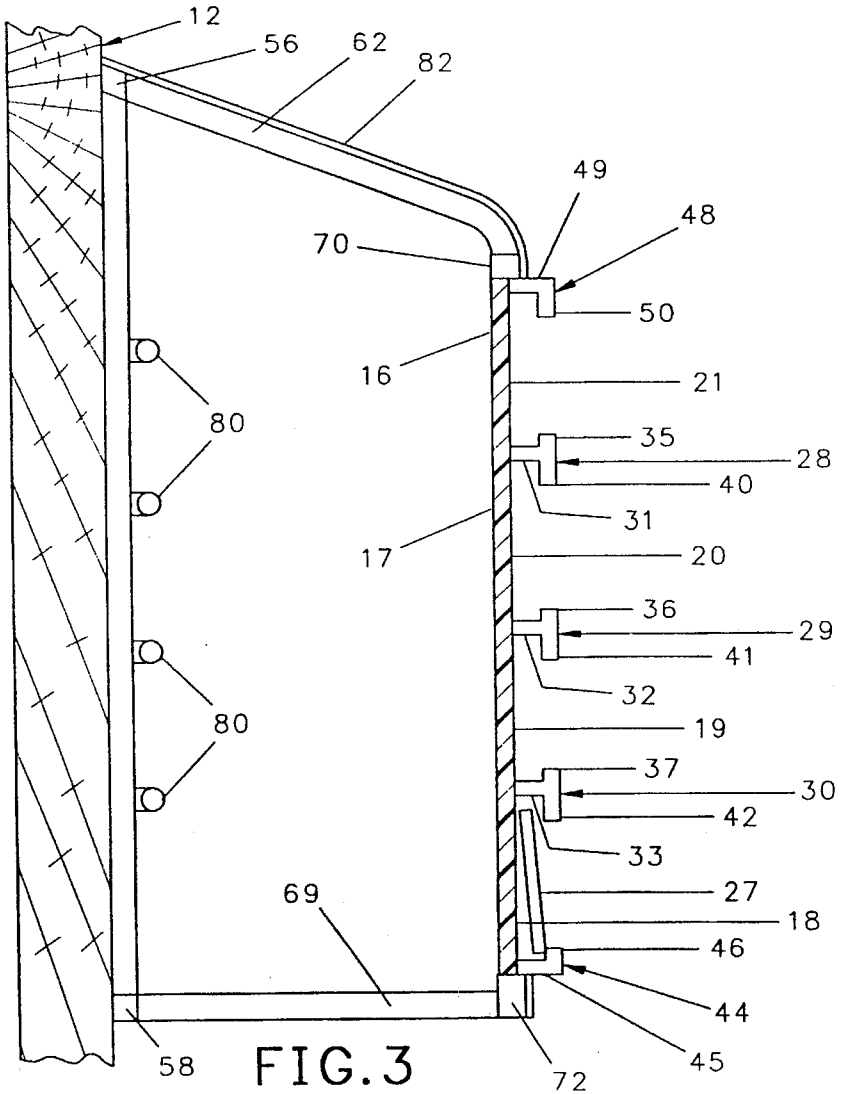
FIG. 3 is an enlarged cross-sectional view of the attraction board mounting structure shown in FIG. 1, taken through lines 3—3 thereof.

Referring to FIGS. 1, 2 and 3, a building having a wall 12 has a mounting structure 14 in accordance with the present invention attached thereto which supports an attraction board 16. The attraction board 16 has a rear panel 17 and a plurality of horizontal tracks 18, 19, 20, 21 thereon, and each of the tracks is adapted to receive replaceable figures panels 24, 25, 26, 27 therein. In this embodiment, the rear panel 17 and tracks 18, 19, 20, 21 form the face of the attraction board. In the preferred embodiment, the rear panel 17 is at least partially transparent to light.

Referring to FIG. 3, between each of the pairs of adjacent tracks, there is an intermediate rail 28, 29, 30 each of which has a support leg 31, 32, 33, an upwardly extending lower lip 35, 36, 37 and a downwardly extending upper lip 40, 41, 42, respectively. The lower track 18 has along its lower edge a lower rail 44 having a support leg 45 and an upwardly extending lower lip 46 and along the upper edge of the upper track 21 is an upper rail 48 having a support leg 49 and a downwardly extending upper lip 50.

The downwardly extending upper lips 40, 41, 42, 50 are a little longer than the upwardly extending lower lips 35, 36, 37, 46. Each figure panel 24, 25, 26, 27 is generally rectangular in shape having a height which is a little greater than the distance between the downwardly extending upper lip and the upwardly extending lower lip of a track. Also, the support legs 31, 32, 33, 45, 49 extend sufficiently far outward from the surface of the rear panel 17 such that figure panels 27 can be retained under the upper and lower lips of a track and against the forward surface 51 of the rear panel 17 to form a display.

To insert a figure panel 27 into a track, an extended arm having a suction cup at the end thereof is used to position the upper edge of a figure panel 27 under a downwardly extending upper lip. Thereafter, the lower edge of the figure panel is moved across the upper edge of the upwardly extending lower lip. The figure panel is then released and allowed to rest on the upper surface of the support arm of the lower rail and is retained between the upper and lower lips of the track.

Referring to FIG. 2, to retain the attraction board 16 to a wall 12, there is provided a frame 54 having an upper horizontal member 56 and a lower horizontal member 58 and extending perpendicularly between the upper and lower members 56, 58, respectively, are a plurality of vertical members 60—60. Extending outwardly of the wall and attached to the upper vertical member 56 are a plurality of parallel spaced first arms 62, the upper surfaces of which define a plane. In the preferred embodiment, the first arms 62 are not perpendicular to the wall 12 but are angled so as to slope downwardly at their distal ends 64—64. Furthermore, the first arms 62—62 may also have a downward curve 66—66 near their distal ends.

Two second arms 68, 69 are also provided, one second arm is positioned at each end of the lower horizontal member 58, and in the preferred embodiment, the second arms 68, 69 are perpendicular to the plane of the wall 12.

A first outer horizontal member 70 is attached to the distal ends 64— 64 of the first arms 62—62 and a second outer horizontal member 72 extends between the outer ends of the second arms 68, 69. Also, a number of vertical members 74—74 extend between the first and second outer horizontal members 70, 72, respectively, to form the frame 54.

As shown in FIG. 2, the rear panel 17 of the attraction board 16 is attached to the frame 54, by any suitable means, such as bolts, not shown. In the preferred embodiment, the upper edge of the rear panel 17 is attached to the first horizontal member 70, and the lower edge attached to the second horizontal member 72, and the sides attached between two of the vertical members 74—74. In accordance with the present invention, a light fixture 80 which can illuminate a window of the business establishment is attached to the vertical member 60—60 so as to provide illumination to the wall, and to the rear of the attraction board 16. Finally, a plastic or canvas awning 82 is extended across the upper surfaces of the first arms 62 and outer surfaces of the vertical member 74—74. In this embodiment, the awning 82 is shaped with edges which abut the sides and top of the rear panel 17 of the attraction board 16.

It should be appreciated that the awning may be first attached to the frame 54 and adapted to extend across the entire width of the frame, and thereafter, the attraction board 16 may be attached to the frame by extending bolts, not shown, through the awning 82 and into the vertical members 74—74 and horizontal member 70, 72 of the frame.

An attraction board, mounted in accordance with the present invention, is usable on structures which otherwise would be unavailable because of the existence of an awning.

Figure 4:
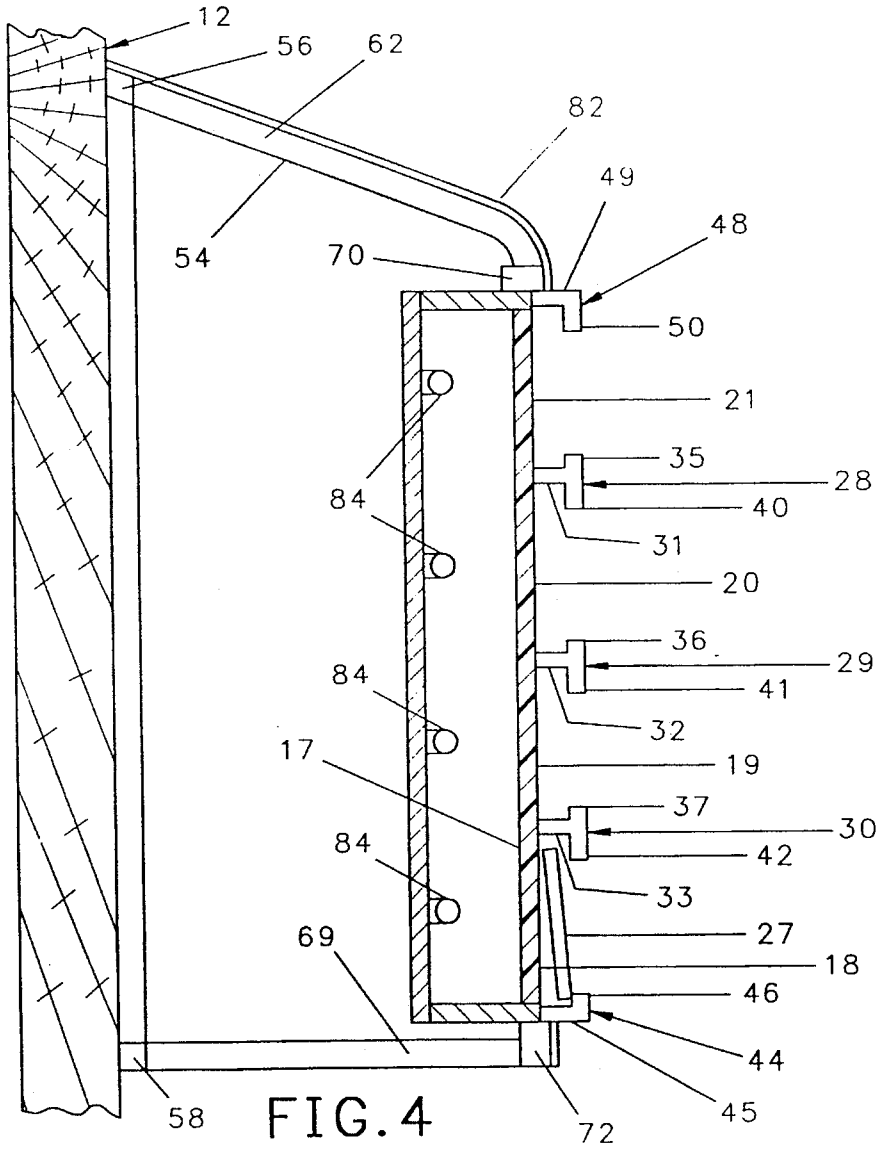
FIG. 4 is an enlarged cross-sectional view of another attraction board mounting structure in accordance with the present invention.

Referring to FIG. 4 in which like elements bear like indicia numbers, an attraction board 16 which includes a light assembly 84 may be recessed into a frame 54 such that the forward surface of the tracks 18, 19, 20, 21 are substantially co-planar with vertical portion of the outer surface of the awning 82.

Figure 5:
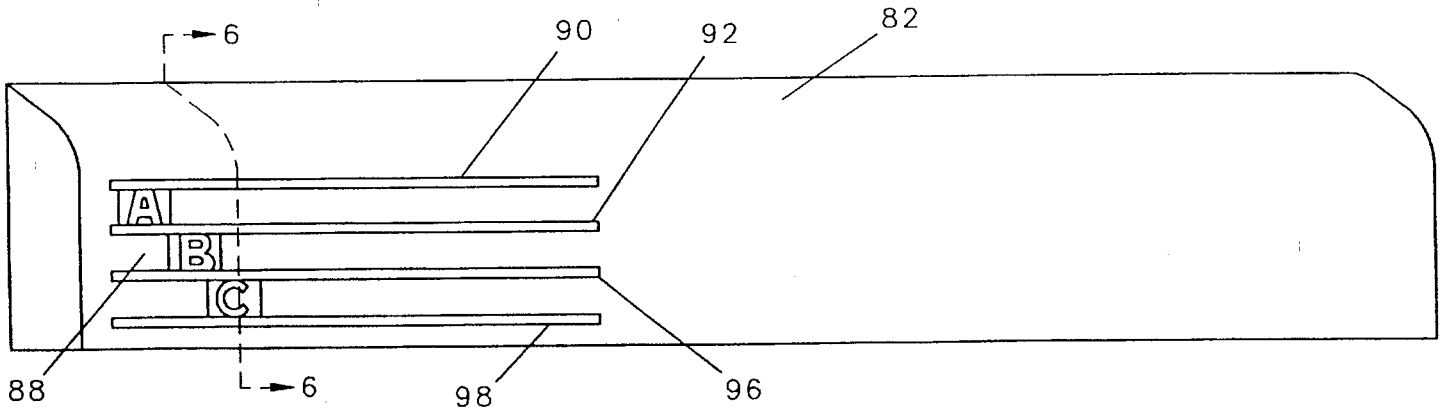
FIG. 5 is an isometric view of another embodiment of the invention.
Figure 6:
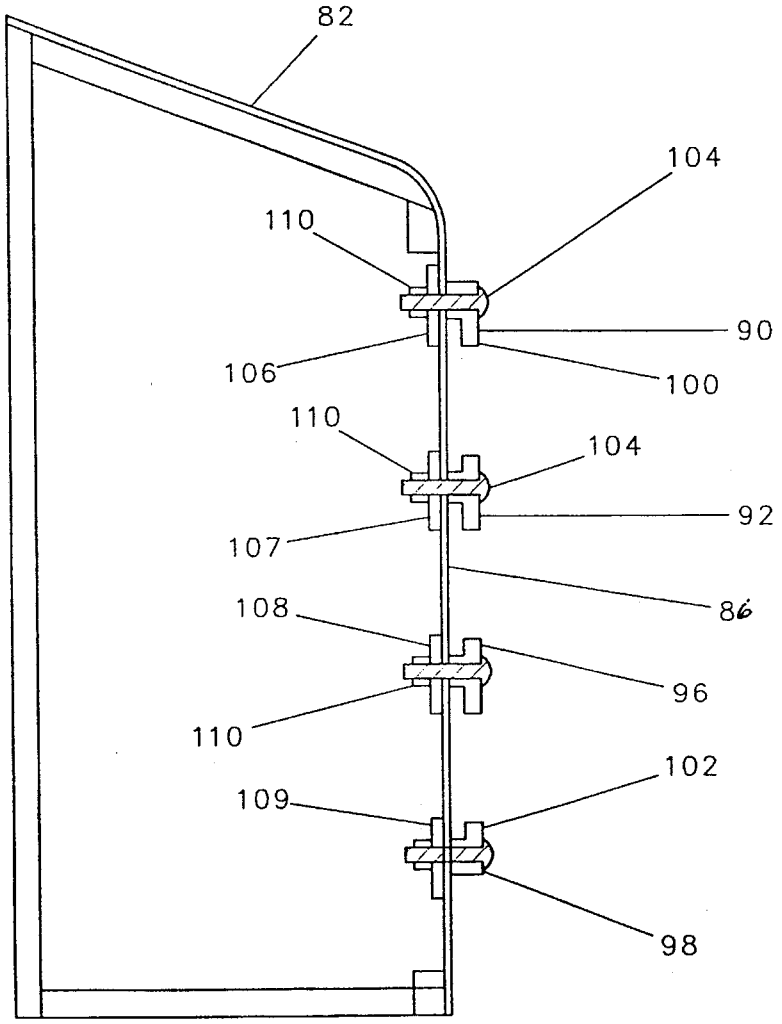
FIG. 6 is an enlarged cross-sectional view of the embodiment shown in FIG. 5 taken through lines 6—6.

Referring to FIGS. 5 and 6, an attraction board mounted in accordance with the present invention may also be constructed using the forward surface 86 of the material of the awning 82 as the rear panel of the attraction board 88. In this embodiment, the attraction board 88 is defined by a plurality of parallel rails 90, 92, 96 and 98. The upper rail 90 has a downwardly extending upper lip 100 and the lower rail 98 has an upwardly extending lower lip 102, and the intermediate rails 92, 96 have support arms, upper lips and lower lips as previously described so as to form a plurality of parallel tracks. Each of the rails is attached to the awning 82 by a plurality of spaced bolts 104—104 which extend through a transverse hole in the associated support arm, through the awning 82, and through a transparent plastic plate, one plate 106, 107, 108, 109 positioned on the rear side of the awning 82 opposite and parallel to each of the rails 90, 92, 96, 98, respectively, and retained by an associated nuts 110—110.

Figure 7:
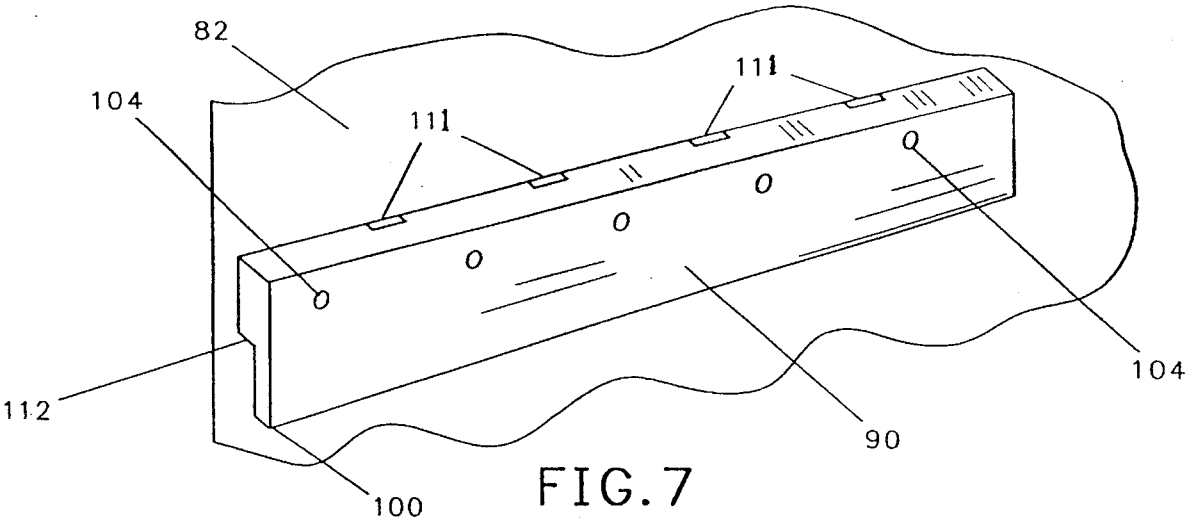
FIG. 7 is an enlarged fragmentary isometric view of a rail of the attraction board shown in FIG. 5.

As shown in FIG. 7, to prevent debris from the awning from collecting within an upwardly extending lower lips of the attraction board, a plurality of spaced vertical transverse slots 111—111 are provided through the inner support arm 112 of each of the rails 90, 92, 96, 98.

Figure 8:
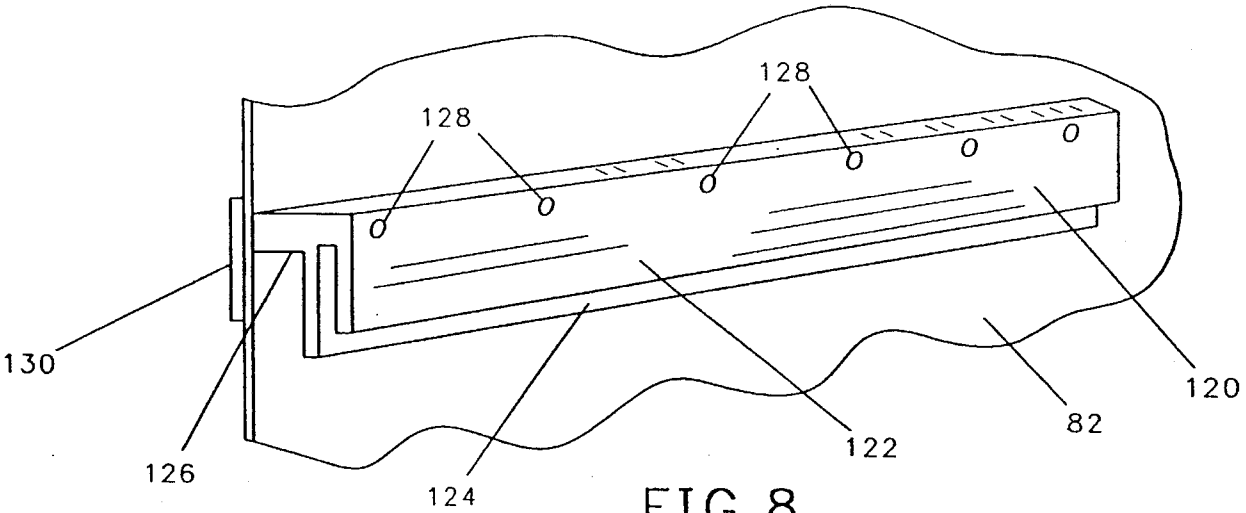
FIG. 8 is an enlarged fragmentary isometric view of another embodiment of a rail suitable for the attraction board shown in FIG. 5.

The rails of an attraction board for which the awning 82 serves as the rear panel, may also have the rails forwardly offset from the front of the awning. Referring to FIG. 8, each such rail 120 has an inner flange 124 and parallel thereto an outer flange 122. A figure panel such as shown bearing indicia number 27 (shown in FIGS. 1 and 4) and described above can be fitted within the track formed between the inner and outer flanges 124, 122 of opposing upper and lower rails. Each rail 120 further has a pedestal portion 126 which forwardly offsets the flanges 122, 124 from the forward surface of the awning 82. The rails 120 are attached to the awning by bolts 128, 128 which extend through spaced holes, not shown, in the rails 120, through the awning 82, and to a support plate 130 on the inner surface of the awning 82, and retained in place by associated nuts, not shown. By forwardly offsetting the tracks of the rails from the surface of an awning as shown, figure panels inserted in the tracks will not cause wear to the surface of the awning.

Figure 9:
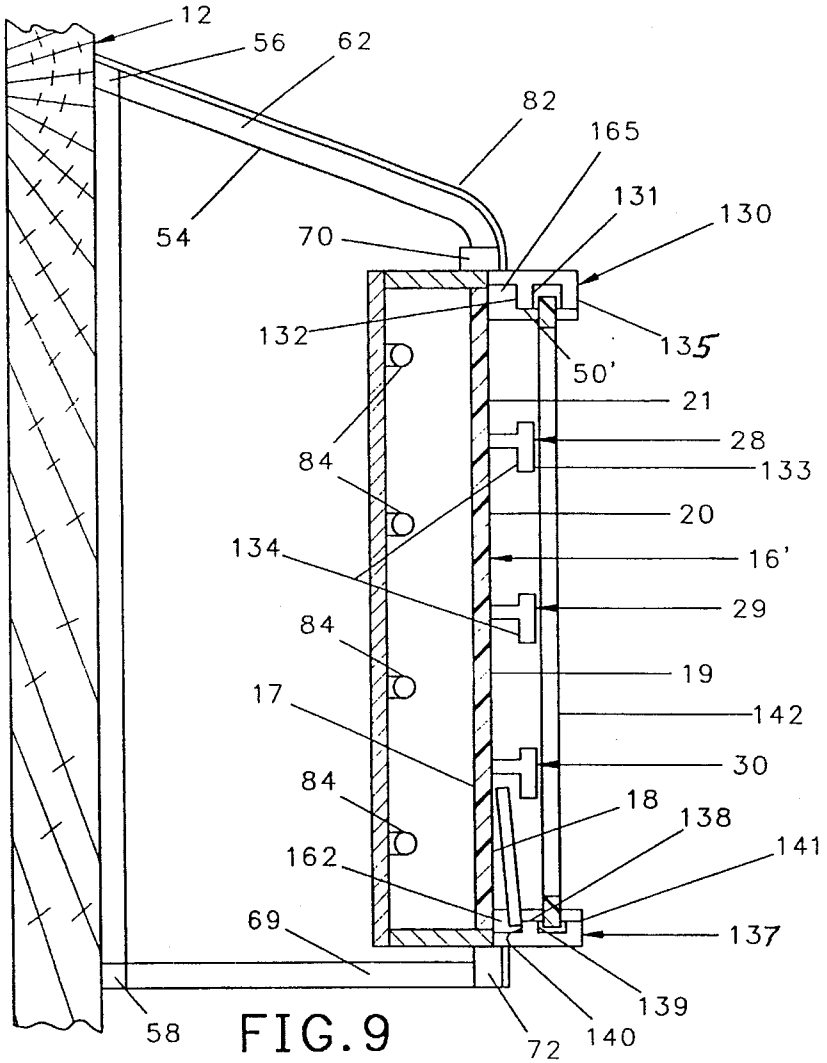
FIG. 9 is an enlarged cross sectional view of an attraction board in accordance with the present invention having forward upper and lower lips and a display panel fitted therebetween.

Referring to FIG. 9, in which elements which are like elements previously defined bear like indicia numbers, another attraction board 16 has a plurality of parallel tracks 18, 19, 20, 21 thereon. In this embodiment, intermediate rails 28, 29, 30 are similar to those depicted in FIGS. 3 and 4. The upper rail 130, however, has a first downwardly extending upper lip 50', the forward and rearward surfaces 131, 132, respectively, of which are substantially coplanar to the forward and rearward surfaces 133, 134, respectively, of the intermediate rails 28, 29, 30. The upper rail 130 further has a forward downwardly extending upper lip 135 which is forwardly offset from the plane of the forward surfaces 131 of the intermediate rails 28, 29, 30 a distance to permit the retention of a retaining frame 136 of a display panel 142 between the first downwardly extending upper lip 50' and the forward downwardly extending upper lip 135. Similarly, the lower rail 137 has a first upwardly extending lower lip 138 having forward and rearward surfaces, 139, 140, respectively, which are substantially coplanar to the forward and rearward surfaces 133, 134 of the intermediate rails 28, 29, 30. The lower rail 137 further has a forward upwardly extending lower lip 141 which is forwardly offset from the first upwardly extending lower lip 138 a distance which will permit a display panel 142 to be fitted between the inner surface of the forward upwardly extending lower lip 141 and the outer surface of the first upwardly extending lower lip 138. The forward downwardly extending upper lip 135 extends downwardly a greater distance than the forward upwardly extending lower lip 141 extends upwardly. Accordingly, a display panel 142 having a frame 136 can be retained under the forward upper lip 135 and the forward lower lip 141.

At each end of the forward upwardly extending lower lip 141 is an end panel 162 and at each end of the forward downwardly extending upper lip 135 is another end panel 165 for retaining the display panel 142 against being blown out the ends of the track by wind.

Figure 11:
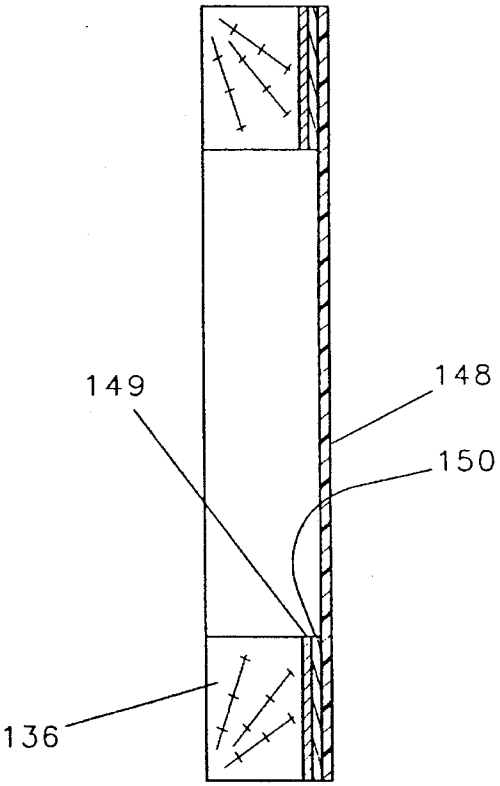
FIG. 11 is an enlarged cross-sectional view of the display panel and retaining frame shown in FIG. 10 taken through line 11—11.
Figure 12:
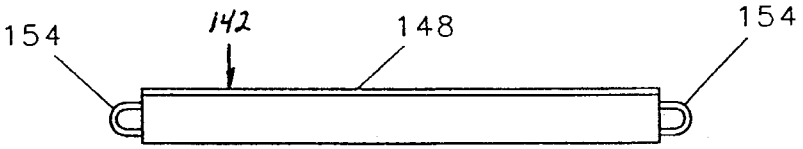
FIG. 12 is a top view of a display panel and retaining frame shown in FIG. 10.
Figure 10:
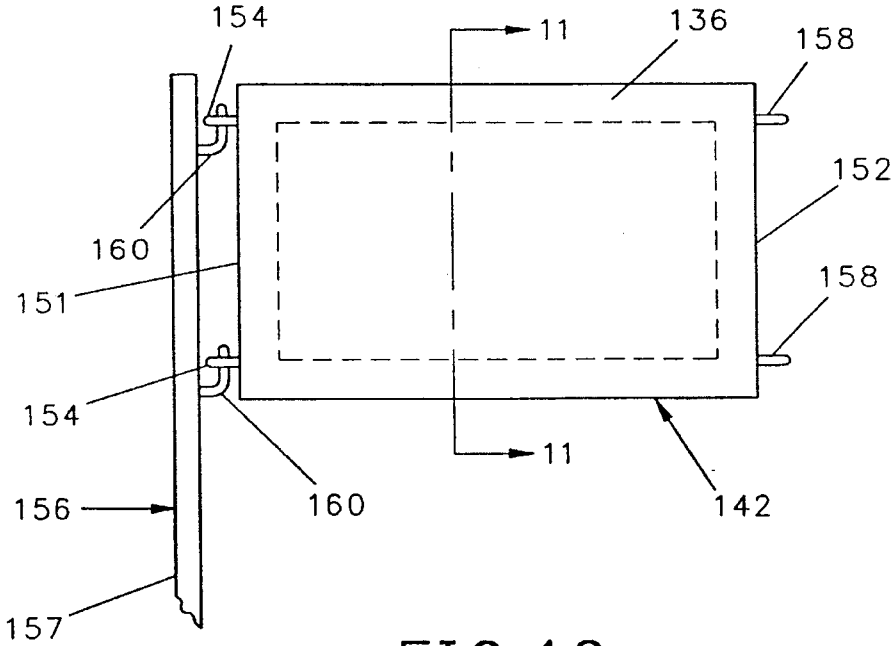
FIG. 10 is a front elevational view of a display panel with the inner edges of a retaining frame shown in broken lines, and showing the use of an installation stick.

As best shown in FIGS. 10, 11 and 12, a sign or display panel 142 is shown which can be fitted across the entire face or rear panel of an attraction board and can be used for retaining signage across the surface of the attraction board instead of the use of individual letters or numbers positioned along the tracks thereof. In the preferred embodiment, the display panel 142 has a rectangular retaining frame 136 and across the forward surface of the retaining frame 136 is a flexible display web 148 which may be made of a plastic or other suitable material upon which the desired signage may be printed. To retain the display web 148 to the retaining frame 136, a suitable means for attachment thereto such as a first strip of material 149 sold under the trademark VELCRO which is attached to the forward surface of the retaining frame 136 and a complementary second strip of VELCRO material 150 is attached along the outer edges of the rear surface of the display web 148. To attach the display web 148 to the retaining frame 136, the edges of the display panel are then aligned with the edges of the retaining frame 136 and the first VELCRO 149 of the display web 148 is pressed against the second VELCRO 150 of the retaining frame 136 to assemble the panel 142.

Along each of the sides 151, 152 of the retaining frame 136 are a plurality of loops 154. To lift the assembled display panel 142 and position it between the forward upper and lower lips 135, 141 of the attraction board 16', one or more installation sticks 156 are provided. Each installation stick 156 has an elongate shaft 157 and fitted near the upper end thereof are one or more upwardly projecting hooks 160. The hooks 160 are spaced along the upper end of the shaft 157 at intervals which correspond to the spacings of the loops 154 along the sides 151, 152 of the frame 136. The preferred method for the installation of a display panel 142 between the forwardly offset upper and lower lips 135, 141 of an attraction board 16' the hooks 160 of one installation stick 156 are inserted into the loops 158 on one side 151 of the display panel 142, and the hooks 160 of a second installation stick 156 are inserted into the loops 158 on the second side 152. Then the two installation sticks 156 are moved in unison by one or more installing personnel to raise the display panel 142 and position it between the forward upper and lower lips 135, 141 of the attraction board 16'.

Figure 13:
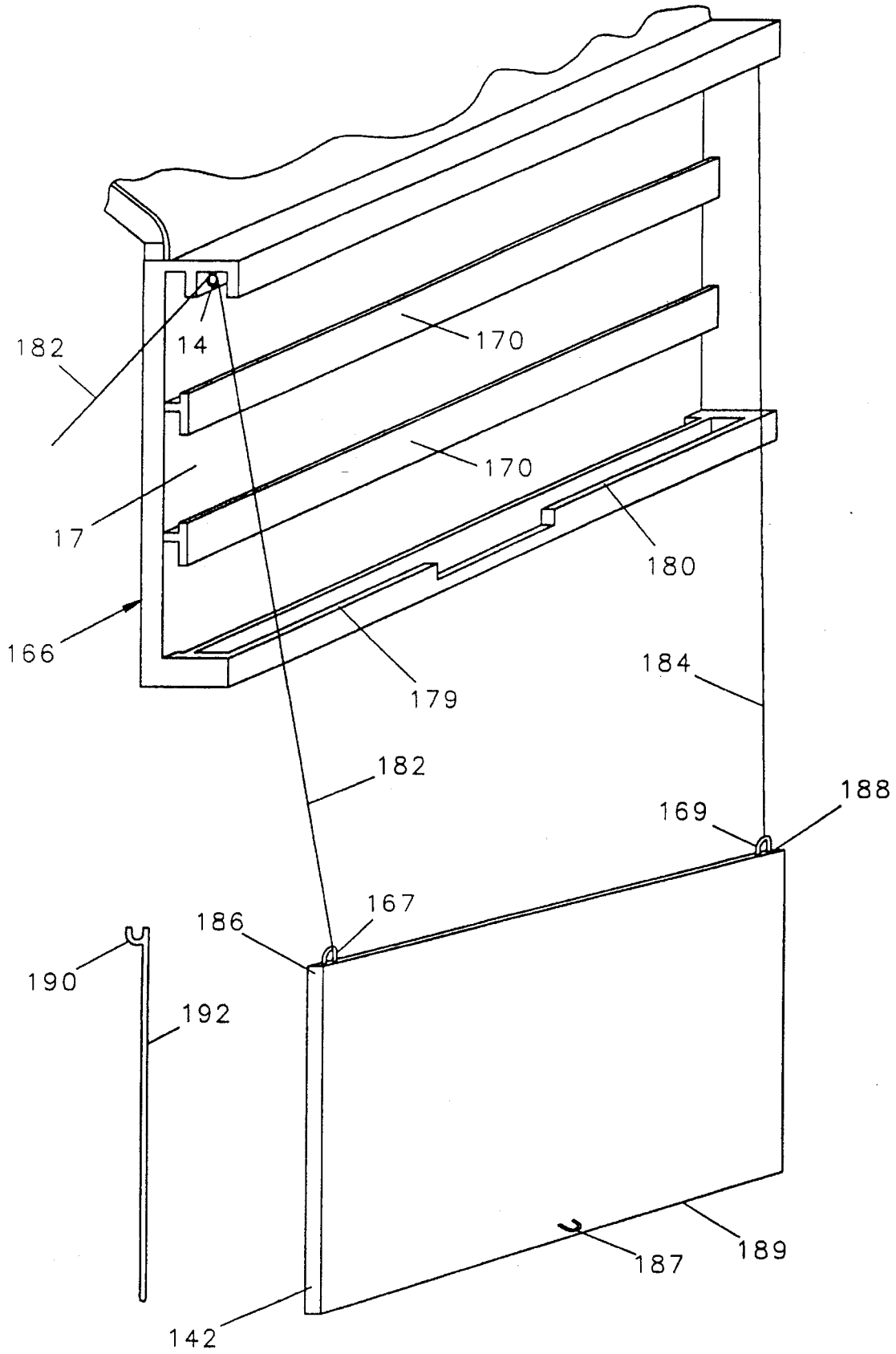
FIG. 13 is a perspective view of another embodiment for attaching a display panel to an attraction board.

As shown in FIGS. 13, the display panel 142 can be retained against the face or forward surface of the rear panel 17 by other means. In this embodiment, an attraction board 166 has a rear panel 17 and a means for forming a display on the rear panel 17, such as a plurality of rails 170. The attraction board 166 is retained in an elevated position with the rear panel 168 substantially vertical by a support structure 172 such as has been previously described.

In this embodiment, a first and second pulley, only one of which 174 is visible, are positioned one on each upper corner at the sides of the attraction board 166. Forward upwardly extending lower lip segments 179, 180 are positioned one on each side of the lower edge of the attraction board 166.

To draw a display panel 142 upward so as to be positioned across the face or forward surface of the rear panel 168, two lines 182, 184 are provided, one passing through the pulley 174 on each side of the attraction board 166 and attached to loops 167, 169 on the upper left and right corners 186, 188, respectively, of the frame 136 of the display panel 142. A loop 187 located midway along the lower edge 189 of the frame 136 of the display panel 142 can be engaged by a hook 190 at the distal end of an elongate stick 192 to assist in the installation of the display panel 142. To install a display panel 142 in accordance with this embodiment, the ends of the lines 182, 184 are first attached to the loops 167, 169 at the upper ends of the frame 136, to which the desired display web 148 has been attached. The display panel 142 is drawn upward when installation persons pull on the free ends of the lines 182, 184 and when the display panel 142 is positioned in front of the rear panel 168, the lower edge 189 of the panel 142 is fitted under the upwardly extending lower lip segments 178, 180 using the hook 190 on the stick 192. The free ends of the lines 182, 184 are then tied down until the display panel 142 is to be removed.

Figure 14:
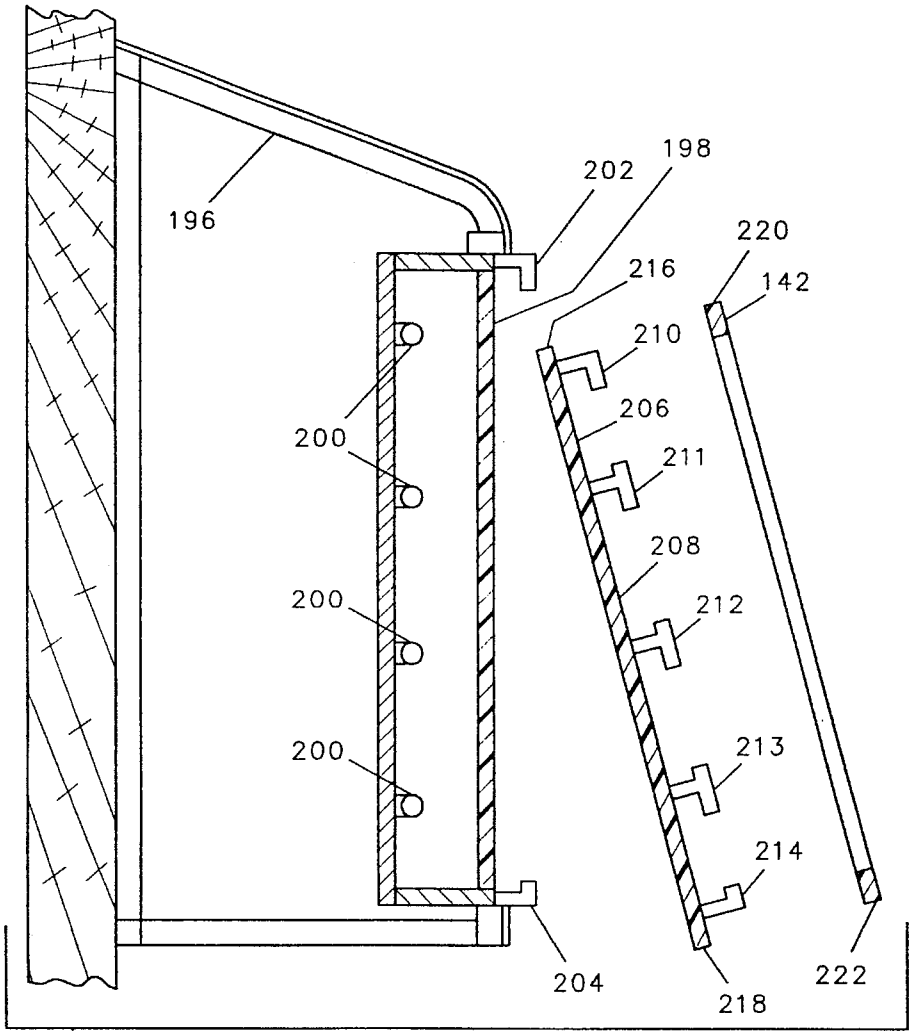
FIG. 14 is a cross-sectional view of an embodiment of a mounting for receiving either a display panel or a panel bearing the face of an attraction board.

Referring to FIG. 14, in which another embodiment of an attraction board mounting capable of retaining a removable display panel 142 is depicted. In this embodiment, a support structure 196 such as described above is used to retain a rear panel 198 in a vertical orientation. The rear panel 198 is partially transparent to light and is illuminated by a plurality of light fixtures 200 similar to those described with reference to FIG. 4. Along the upper edge of the rear panel is a forward downwardly extending upper lip 202 and along the lower edge of the rear panel 198 is a forward upwardly extending lower lip 204.

In this embodiment, the face 206 of the attraction board is mounted on a separate panel 208. As can be seen, the face 206 of the attraction board includes a plurality of rails 210, 211, 212, 213, 214, and the upper rail 210 is spaced a short distance below the upper end 216 of the panel 208, and the lower rail 214 is spaced a short distance above the lower end 218 of the panel 208.

The upper end 216 and lower end 218 of the panel 208 are parallel to each other and are spaced such that the panel 208 and the face 206 of the attraction board can be removably positioned under the forward upper and lower lips 202, 204, respectively, using methods previously described. In this embodiment, a display panel 142 having upper and lower parallel ends 220, 222, respectively, which are spaced a distance equal to the spacings of the upper and lower ends 216, 218, respectively, of the panel 208 can be installed in substitution for the panel 208 and the attraction board face 206. In this embodiment, the attraction board face 206 is removed and replaced by the display panel 142 when it is desirable to provide signage across the rear panel 198.

Figure 15:
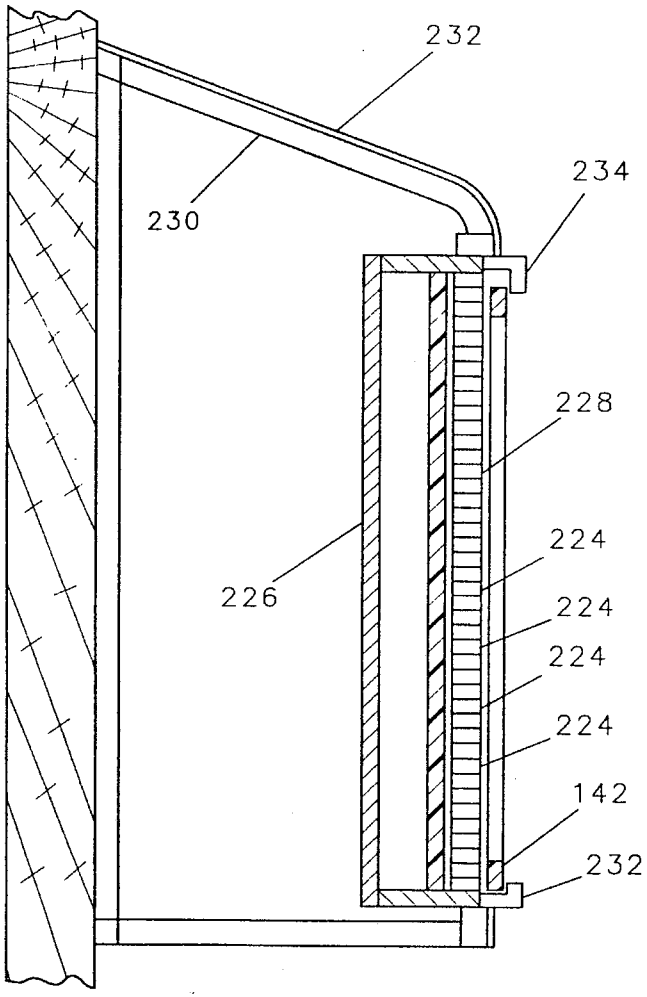
FIG. 15 is a cross-sectional view of an electronically operated attraction board on a mounting structure and having a forward upper and lower lip for retaining a display panel, all in accordance with the present invention.

As shown in FIG. 15, although the attraction boards previously described herein are of the type having a plurality of rails thereon to form a plurality of tracks, other forms of attraction boards exist, such as an electronically operated board having a computer (not shown) to eliminate an array of light emitting diodes (LED array) 224 or the like. In this embodiment, the LED array 224 is mounted on a substrate 226 having a printed circuit therein and the substrate 226 serves as a rear panel of the attraction board 228. The attraction board 228 is mounted on a mounting structure 230 having an awning 232 as previously described. Attached across the forward surface of the substrate and the LED array 224 is a removable display panel 142 as previously described. In this embodiment, the means for retaining the display panel 142 is a forward upwardly extending lower lip 233 and a forward downwardly extending upper lip 234.

Figure 16:
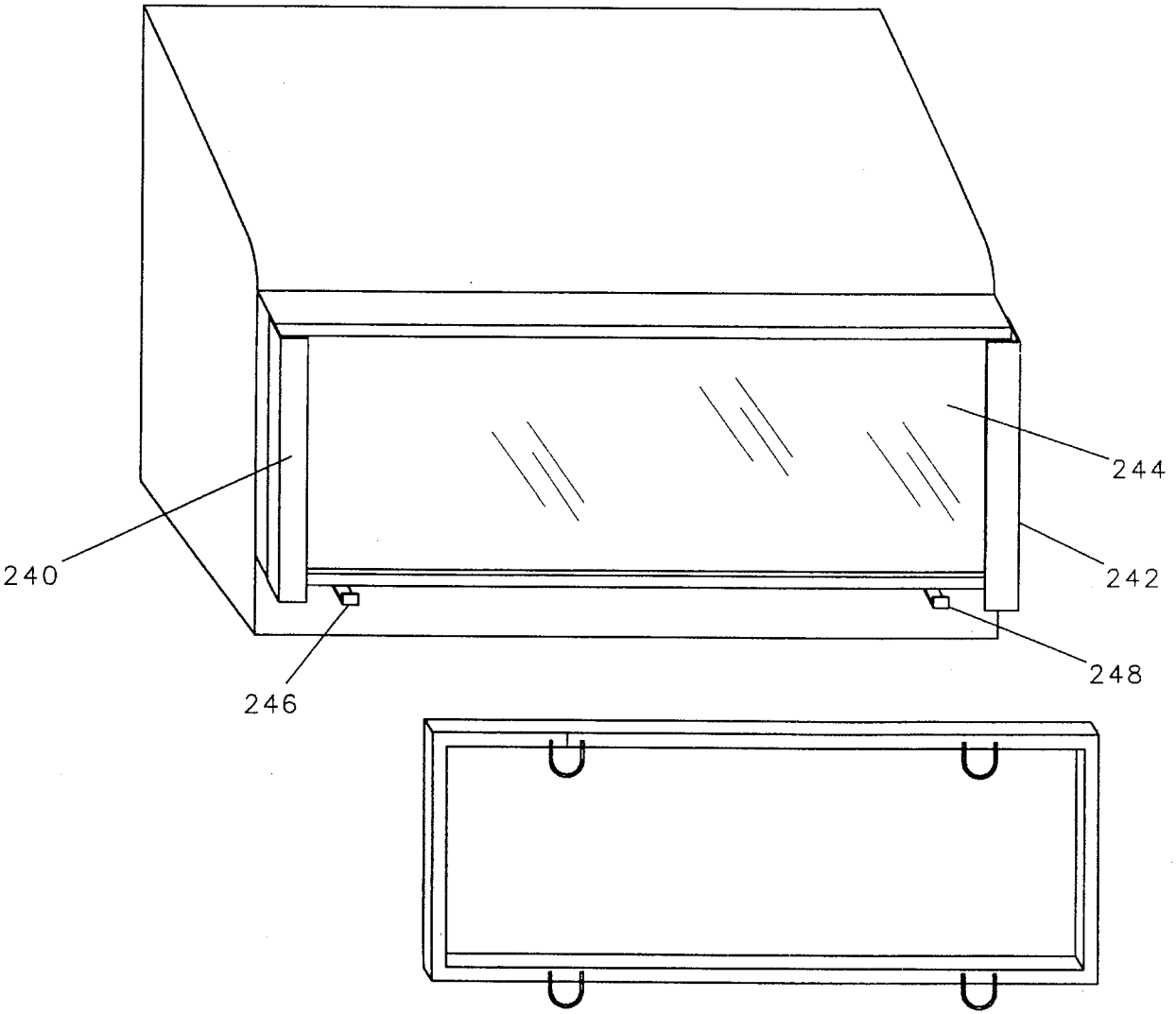
FIG. 16 is a perspective view of another embodiment for attaching a display panel to an attraction board.

It should be appreciated that a display panel 142 can be retained at the sides thereof against an attraction board by hooks, or as shown in FIG. 16, by the provision of lips 240, 242 positioned along the sides of an attraction board 244 extending towards each other. Supports 246 and 248 along the bottom edge of the attraction board retain the display panel 142 from sliding out the bottom end of the lips 240, 242. It should also be appreciated that the removable display panel attached to an attraction board may also be used in connection with conventional wall mountings or free standing mountings for attraction boards.

There has, therefore, been described a structure for mounting an attraction board to a wall of a building for use of the attraction board in conjunction with the awning, and an improved attraction board for retaining signage across the face thereof.

While the present invention has been described in various specific embodiments, it will be appreciated by those skilled in the art that many changes may be made without departing from the true spirit and scope of the present invention. Therefore, it is the intention of the appended claims to cover all such changes and modifications which come within the true spirit and scope of the invention.

What is claimed:

1. An attraction board comprising in combination:

a immovable substantially vertical rear panel having a forward surface, a plurality of horizontal longitudinal tracks on said forward surface, each of said tracks having means for visibly displaying a plurality of individually changeable symbols in side-by side relationship along the length thereof and independent of any other track, said means for visibly displaying being immovably fixed to said rear panel, and track means for removably retaining a first end and an opposing second end of a rigid planar panel of signage across a portion of said forward surface of said rear panel and across a plurality of said tracks whereby said rigid panel is retained without deforming any portion of said panel.

2. The attraction board in accordance with claim 1 wherein each of said plurality of tracks is defined by an upwardly extending lower lip and a parallel downwardly extending upper lip.

3. An attraction board in accordance with claim 1 wherein said tracks include an electronic display.

4. An attraction board in accordance with claim 1 wherein said means for moveably retaining a panel of signage further comprises a forward downwardly extending upper lip, and a forward upwardly extending lower lip, said forward upper and lower lips aligned to receive an undeformed rigid planar panel therebetween.

5. The method of displaying a sign comprising the steps of:

providing a vertically oriented attraction board having an immovable rear panel with a plurality of horizontal tracks thereon, said tracks being immovably fixed to said rear panel, each of said tracks having means for forming a display of visible symbols along the length thereof independent of any other track, attaching a forwardly offset downwardly extending upper lip along an upper edge of said attraction board, attaching a forwardly offset upwardly extending lower lip along a lower edge of said attraction board, said forwardly offset upwardly extending lower lip aligned with said forwardly offset downwardly extending upper lip to receive opposing ends of an underformed planar panel therebetween, and fitting opposing ends of a removable planar panel of signage between said forwardly offset upper lip and said forwardly offset lower lip and forward of said plurality of said horizontal tracks without deforming said planar panel.

6. The combination comprising:

a support means, retaining means for removably retaining a planar member on said support means in a vertical orientation, attraction board means removably retainable on said retaining means, said attraction board means being a plurality of parallel tracks on a rear panel, said tracks being immovably fixed to said rear panel, each of said tracks for displaying a plurality of changeable figures thereon independent of any other of said tracks, rigid planar display panel means removably attachable on said retaining means, and one of said attraction board means and said display panel means removably retained on said support means by said retaining means.

7. An attraction board comprising in combination:

a substantially vertical immovable rear panel having a forward surface, a plurality of tracks on said forward surface of said rear panel including an upper track and a lower track, said tracks defined by a plurality of horizontal rails attached to said forward surface including an upper rail, at least one intermediate rail, and a lower rail, said rails being immovably fixed to said rear panel, said at least one intermediate rail having a forward surface, and means for removably retaining a first end and an opposing second end of a rigid panel of signage across a portion of said forward surface of said rear panel and across said forward surface of said at least one intermediate rail, whereby said planar panel is not deformed to be retained thereon.

8. In an attraction board of the type having a vertical immovable rear panel and a plurality of horizontal tracks attached to said rear panel, including an upper track and a lower track, each of said tracks having a first downwardly extending upper lip and a first upwardly extending lower lip for receiving a plurality of figure panels between said first downwardly extending upper lip and said first upwardly extending lower lip thereof, said lips being immovably fixed to said rear panel, the improvement comprising:

a second downwardly extending upper lip extending along said first downwardly extending upper lip of said upper track and forward thereof, a second upwardly extending lower lip extending along said first upwardly extending lower lip of said lower track and forward thereof, and said second downwardly extending upper lip and said second upwardly extending lower lip aligned to retain opposing ends of an underformed rigid planar panel of signage therebetween.

* * * * *